US006427370B1

(12) United States Patent
Smith

(10) Patent No.: US 6,427,370 B1
(45) Date of Patent: Aug. 6, 2002

(54) PICTURE FRAME WITH SOUND AND MOTION PRODUCING MEANS

(76) Inventor: Nathan Smith, 4307 Avocado St. #D, Los Angeles, CA (US) 90027

( * ) Notice: Subject to any disclaimer, the term of this patent is extended or adjusted under 35 U.S.C. 154(b) by 0 days.

(21) Appl. No.: 09/951,517

(22) Filed: Sep. 14, 2001

(51) Int. Cl.[7] ..... G09F 27/00

(52) U.S. Cl. ..... 40/717; 40/455; 40/456; 40/720; 40/906; 40/473

(58) Field of Search ..... 40/455, 456, 473, 40/717, 720, 728, 906; 84/94.2, 95.2

(56) References Cited

U.S. PATENT DOCUMENTS 2,084,808 A * 6/1937 Hyde ..... 40/455
3,835,640 A * 9/1974 Hughes, Jr. ..... 40/455
4,910,897 A * 3/1990 Hsu ..... 40/456
5,022,016 A * 6/1991 Smith et al. ..... 40/728
5,309,657 A * 5/1994 Spencer ..... 40/473

* cited by examiner

*Primary Examiner*—Cassandra H. Davis
(74) *Attorney, Agent, or Firm*—Liniak, Berenato, Longacre & White

(57) ABSTRACT

A picture frame includes a frame body having both a sound generating mechanism and a movement mechanism connected to the picture frame. In one embodiment, the movement mechanism comprises a winding member providing additional ornamentation for the picture frame. In another embodiment, the winding mechanism forms part of the support structure for the picture frame. The picture frame has a multi-dimensional sense of beauty by enabling not only an audible component but also a spatial component through movement along a space adjacent to the picture being displayed.

12 Claims, 3 Drawing Sheets

PICTURE FRAME WITH SOUND AND MOTION PRODUCING MEANS

BACKGROUND OF THE INVENTION

1. Field of the Invention

The present invention relates to a picture frame having sound and motion producing means, and more particularly relates to a picture frame having enhanced aesthetics through a unique arrangement of the sound and motion producing devices and functions.

2. Description of Related Art

A normal picture frame is simply a standing ornamental frame for holding a picture. Various types of picture frames made from any of a variety of materials have been disclosed for showing pictures. According to conventional manufacturing methods, a picture frame provides only a static sense of beauty. Because it is a standing object, it is monotonous and less attractive.

Various audio/visual combinations have been proposed in the past in which a picture, for example of a person, is displayed in a picture frame which is associated with some type of sound producing device. Some conventional devices provide personalized messages and songs. These conventional devices lack the necessary spatial or moving component to enhance visual attractiveness or beauty in conjunction with the musical component.

The need exists for a picture frame having a multi-dimensional sense of beauty by providing an auditory attractiveness as well as a spatial and/or kinetic attractiveness.

SUMMARY OF THE INVENTION

The present invention provides a picture frame having a multi-dimensional sense of beauty by enabling not only an auditory component but also a spatial component through movement along a space adjacent the picture being displayed.

In accordance with one embodiment of this invention, a picture frame is provided with both a sound generating mechanism and a movement mechanism disposed on the front of the picture frame adjacent the picture being displayed. The movement mechanism comprises a winding member providing additional ornamentation for the picture frame. Other combinations of sound and movement generating mechanisms are envisioned by the present disclosure whereby the visual component of the picture is enhance by two additional sensory elements, the first being auditory and the second being physical movement.

These and other objects of the present invention will be clearly understood with reference to the accompanying drawings associated herewith.

DETAILED DESCRIPTION OF THE PREFERRED EMBODIMENT

Figure 1:
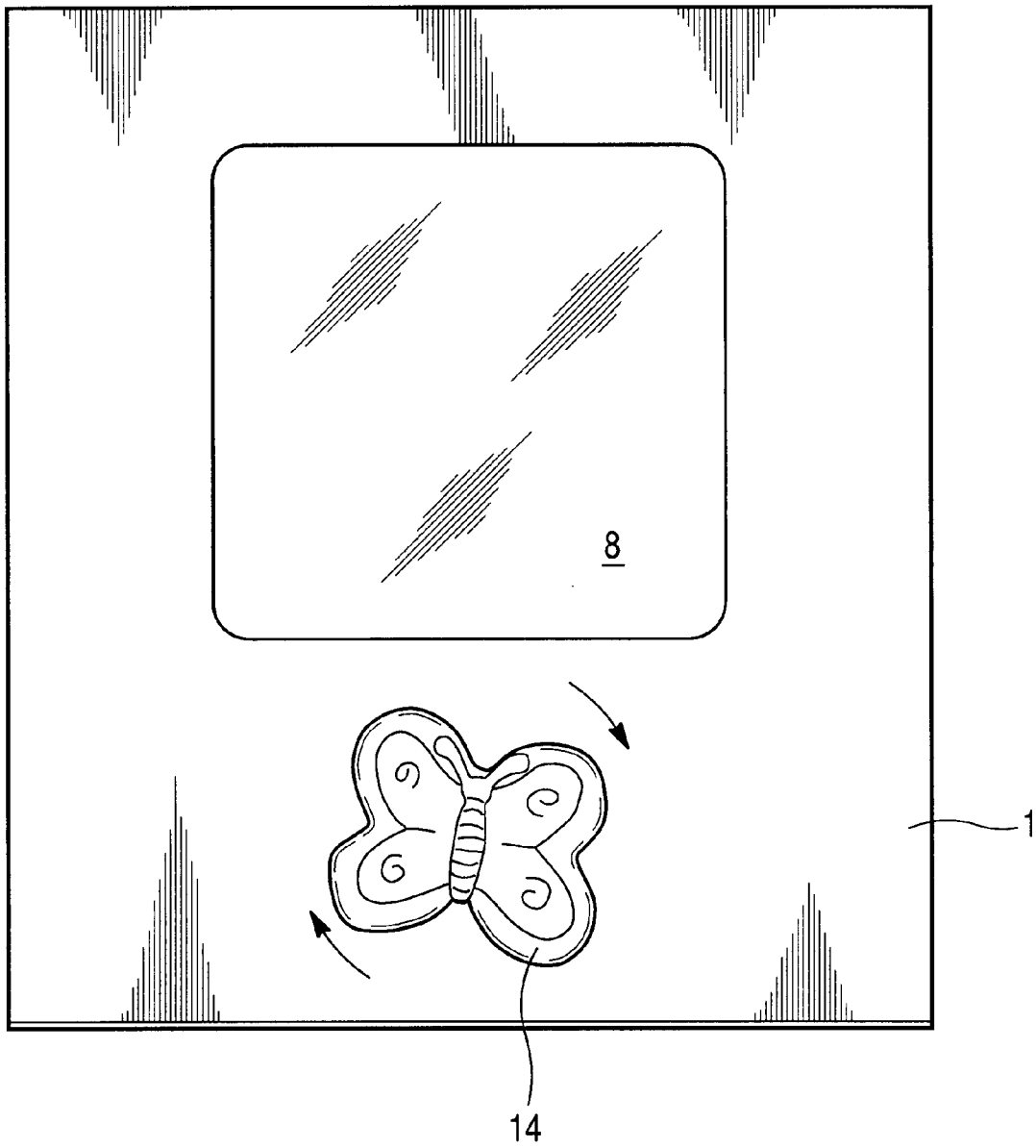
FIG. 1 is a front elevation view of a picture frame according to the preferred embodiment of the present invention.
Figure 2:
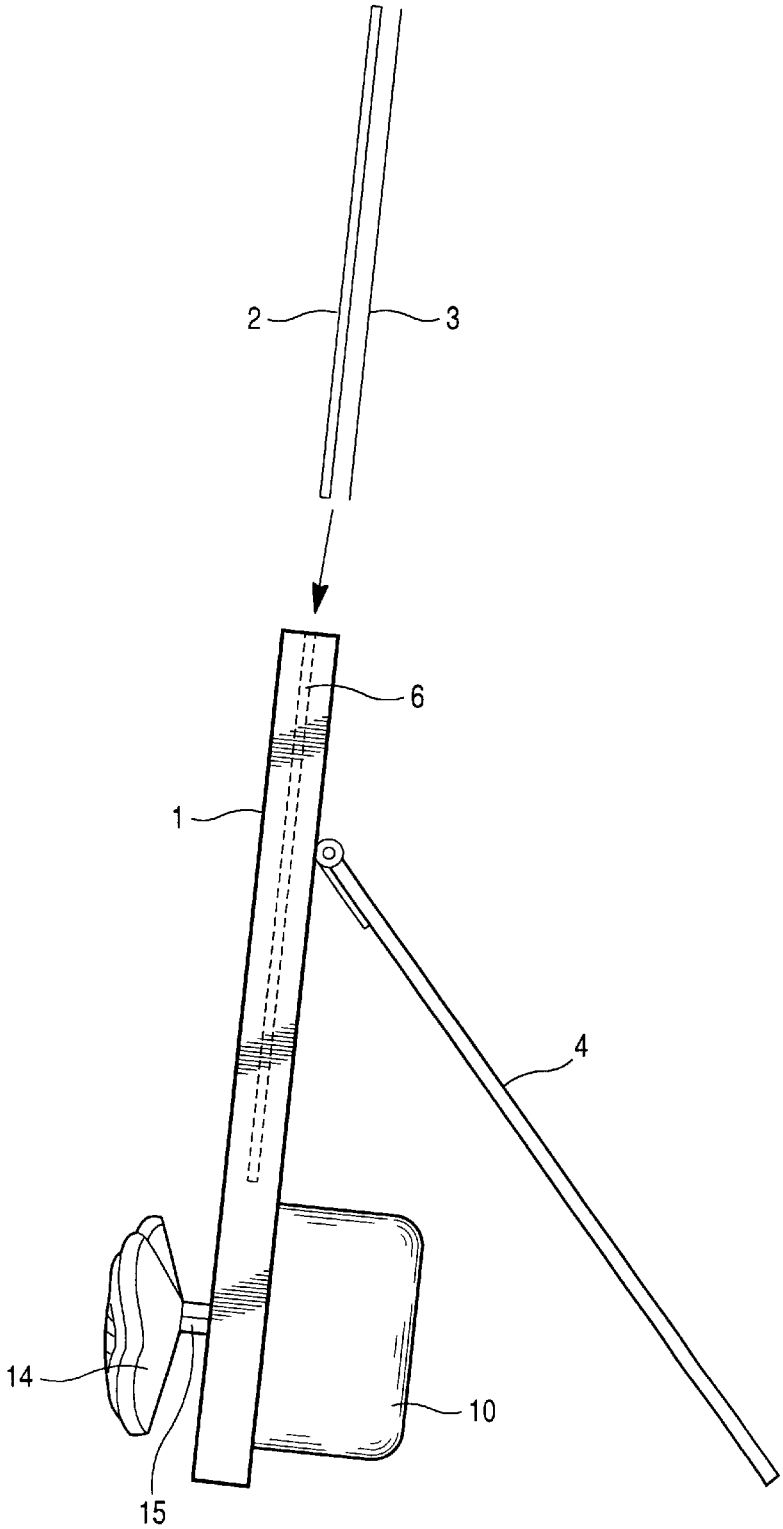
FIG. 2 is a side view of the picture frame of FIG. 1.

Referring to FIGS. 1 and 2, a picture frame in accordance with the present invention is generally comprised of a frame body 1, a glass cover 2, a picture 3, an optional stand or support structure 4, and a sound generating mechanism 10. By way of example, the frame body 1 may be made of an open frame having a picture-receiving slot 6 disposed therein and a viewing window 8 formed in a front surface of the body 1 and leading to the picture-receiving slot 6. The picture-receiving slot 6 receives the glass 2 and the picture 3, and a fixing member 9 is typically provided to retain the glass 2 and picture 3 within the slot 6.

The sound generating mechanism 10 comprises a wind-up musical mechanism 12, a winder 14 and a post 15 connecting the winder 14 to the musical mechanism 12. According to the primary purpose of this invention, the sound generating mechanism 10 is designed to provide a pleasing sound component as well a pleasing visual component functioning in unison. More specifically, the sound generating mechanism 10 plays musical after being wound up via the winder 14 thus providing the pleasing sound component, and the winder 14 rotates along the front surface of the body 1 to enhance the visual aspect of the picture frame itself by providing physical movement.

It should be noted that the physical relationship of the picture 3, window 8, and winder 14 may be varied to balance the visual experience provided by the picture 3 with the visual experience provided by movement of the winder.

In the preferred embodiment, the sound generating mechanism 10 is a mechanical device operating on a spring winding force; however, it will be understood by those of skill in the art that an electrical sound generating mechanism may be provided whereby electrical power is used to generate both the sound component and moving visual component for the picture frame.

Figure 3:
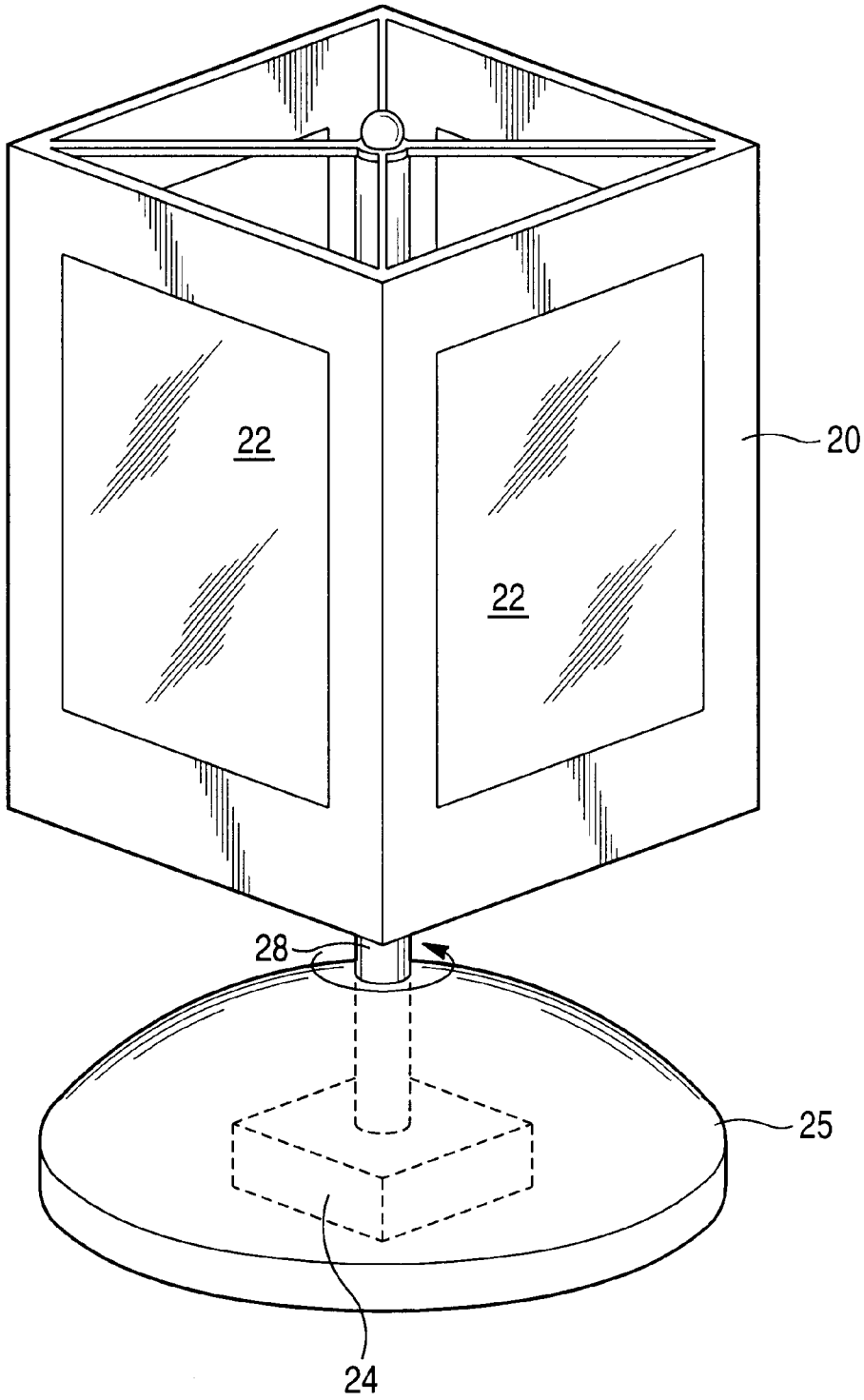
FIG. 3 is a perspective view of a picture frame according to an alternate embodiment of this invention.

FIG. 3 shows an alternate embodiment of the invention whereby the picture frame main body 20 may be used to display one picture 22 or a plurality of pictures 22. The picture frame main body is mounted on a support structure that is designed to provide the musical or auditory component via a music box 24 mounted in the base 25. In addition, the picture frame main body 20 is mounted to the base 25 through a rotating mounting post 28, which rotates upon actuation of the music box 24. When the post 28 rotates, the picture frame main body 20 rotates to enhance the visual effect provided by the pictures 22 mounted on the frame 20.

Based on the foregoing description and the accompanying drawings, it is clear that the present invention provides a picture frame comprising both a sound generating mechanism and a movement mechanism for the picture frame. In the preferred embodiment, the movement mechanism comprises a winding member providing additional ornamentation for the picture frame. Other combinations of sound and movement generating mechanisms are envisioned by the present disclosure whereby the visual component of the picture is enhance by two additional sensory elements, the first being auditory and the second being physical movement.

It will be understood by those of skill in the art that various changes in form and detail may be made herein without departing from the spirit and scope of the present invention. For example, the preferred embodiment of this invention provides a hymn or song as the auditory component; however, the sound may be a recorded message, note or greeting to personalize the sound component of this invention.

What is claimed is:

1. A picture frame comprising:

a frame body having a viewing window on a front surface of said frame body;

a sound producing assembly fastened to said frame body for producing an audible hymn;

a motion producing assembly disposed along said frame body, said motion producing assembly having a moving body adjacent said viewing window;

wherein said sound producing assembly and said motion producing assembly function simultaneously to enhance an aesthetic appearance of a picture disposed within said picture frame, and wherein said motion producing assembly comprises a winding member disposed along said front surface, wherein said winding member rotates as said sound producing assembly plays said audible hymn.

2. The picture frame according to claim 1, further comprising a window member disposed in said viewing window to protect a picture disposed within said viewing window.

3. The picture frame according to claim 1, further comprising a support member for supporting said frame body on a substrate.

4. The picture frame according to claim 1, further comprising a picture retention member for retaining a picture within said viewing window.

5. The picture frame according to claim 1, wherein said winding member passes in front of a viewing plane of said viewing window.

6. The picture frame according to claim 1, wherein said winding member is designed with an appearance that emulates a living creature.

7. The picture frame according to claim 1, wherein said winding member is designed with an ornamental appearance.

8. A picture frame comprising:

a frame body having a viewing window on a surface of said frame body;

a sound producing assembly fastened to said frame body for producing an auditory component;

a motion producing assembly connected to said frame body, said motion producing assembly causing a movement simultaneously with said auditory component;

wherein said sound producing assembly and said motion producing assembly function simultaneously to enhance aesthetic qualities of a picture disposed within said picture frame, and wherein said motion producing assembly comprises a winding member disposed along said surface, wherein said winding member rotates as said sound producing assembly plays said audible hymn.

9. The picture frame according to claim 8, further comprising a window member slidably engaged in said viewing window to protect a picture disposed within said viewing window.

10. The picture frame according to claim 8, further comprising a support member.

11. The picture frame according to claim 8, wherein said motion producing assembly comprises a rotating mounting post supporting said frame body, said mounting post rotating said frame body when said sound producing assembly produces said auditory component.

12. The picture frame according to claim 8, wherein said winding member passes in front of a viewing plane of said viewing window.

* * * * *